United States Patent [19]

Stockbridge

[11] 4,429,190

[45] Jan. 31, 1984

[54] CONTINUOUS STRIP ELECTRET TRANSDUCER ARRAY

[75] Inventor: Christopher D. G. Stockbridge, Rumson, N.J.

[73] Assignee: Bell Telephone Laboratories, Incorporated, Murray Hill, N.J.

[21] Appl. No.: 323,668

[22] Filed: Nov. 20, 1981

[51] Int. Cl.[3] ..... H04R 19/00

[52] U.S. Cl. ..... 179/111 E; 179/111 R; 307/400; 29/592 E

[58] Field of Search ..... 179/111 E, 1 DM, 111 R; 307/400; 29/592 R, 592 E, 594

[56] References Cited

U.S. PATENT DOCUMENTS 3,588,382 6/1971 Reedyk ..... 179/111 E 3,908,098 9/1975 Kawakami et al. ..... 179/111 R

FOREIGN PATENT DOCUMENTS 1239658 7/1971 United Kingdom ..... 179/111 R

OTHER PUBLICATIONS

"Electrostatic Microphones with Electret Foil," G. M. Sessler, The Journal of the Acoustical Society of America, Sep. 1963, vol. 35, No. 9, pp. 1354–1357.

*Primary Examiner*—A. D. Pellinen

*Assistant Examiner*—Danito R. Byrd

*Attorney, Agent, or Firm*—Robert O. Nimtz; Jack S. Cubert

[57] ABSTRACT

A rough surfaced backplate has deposited thereon a metallic electrode having a plurality of large areas interconnected by thin strips. The large areas are symmetrically located on opposite sides of the center of the metallic electrode. Furthermore, the distances between the areas is nonlinear. Superimposed on the metallic electrode is an electret foil having a uniform electrostatic charge deposited on the polymer surface thereof.

7 Claims, 1 Drawing Figure

CONTINUOUS STRIP ELECTRET TRANSDUCER ARRAY

TECHNICAL FIELD

This invention relates to acoustic arrays and, in particular, to an electret transducer for producing a directional response.

BACKGROUND OF THE INVENTION

In U.S. patent application having Ser. No. 104,375 filed Dec. 17, 1979 by Mr. Robert L. Wallace, Jr., and assigned to the same assignee herein, and now U.S. Pat. No. 4,311,874 there are disclosed acoustic arrays, each comprising a plurality of discrete transducers. The discrete transducers are located with precision according to a predetermined relationship in order to produce a response pattern with preselected directional characteristics.

SUMMARY OF THE INVENTION

In accordance with the illustrative embodiment of the present invention, there is disclosed an improved acoustic array for producing a directional response pattern. The directional response pattern comprises a main lobe and a plurality of sidelobes at or below a predetermined threshold level.

The aforesaid improved acoustic array comprises an electret foil superimposed directly on a backplate. The electret foil comprises two layers: a metal layer and a polymer layer having a uniform charge induced therein. The backplate surface facing the electret foil is rough for providing irregular air cavities therebetween. Furthermore, the rough surfaced backplate has deposited thereon a metallic elecrode. The metallic electrode comprises a plurality of discrete areas interconnected by thin strips. The aforesaid discrete areas are located symmetrically on opposite sides of a center of the aforesaid metallic electrode. Furthermore, the relationship among the centers of the aforesaid discrete areas in nonlinear.

In the preferred embodiment of the present invention, the electret foil and the backplate are rectangular and the assembled acoustic transducer is thin.

In another embodiment of the present invention, the metallic layer of the aforesaid electret foil has a plurality of discrete areas interconnected by thin strips as described hereinabove and the metallic layer on the backplate is uniformly wide.

Because the discrete areas are interconnected, an advantage of the present invention is the need for only one amplifier. That is, the acoustic waves are transformed into electrical signals and summed within the transducer.

Because a single backplate is used, as opposed to the use of discrete microphones, the aforesaid acoustic transducer may be mass manufactured in a single step or series of operations.

Because the materials used in the fabrication of the aforesaid acoustic transducer can be made pliable, the assembled device may be conveniently rolled into a smaller package than a rigid device for shipping or transportation as part of a portable teleconferencing set.

BRIEF DESCRIPTION OF THE DRAWING

The single FIGURE shows in exploded view the acoustic transducer embodying the present invention.

DETAILED DESCRIPTION

Figure 1:
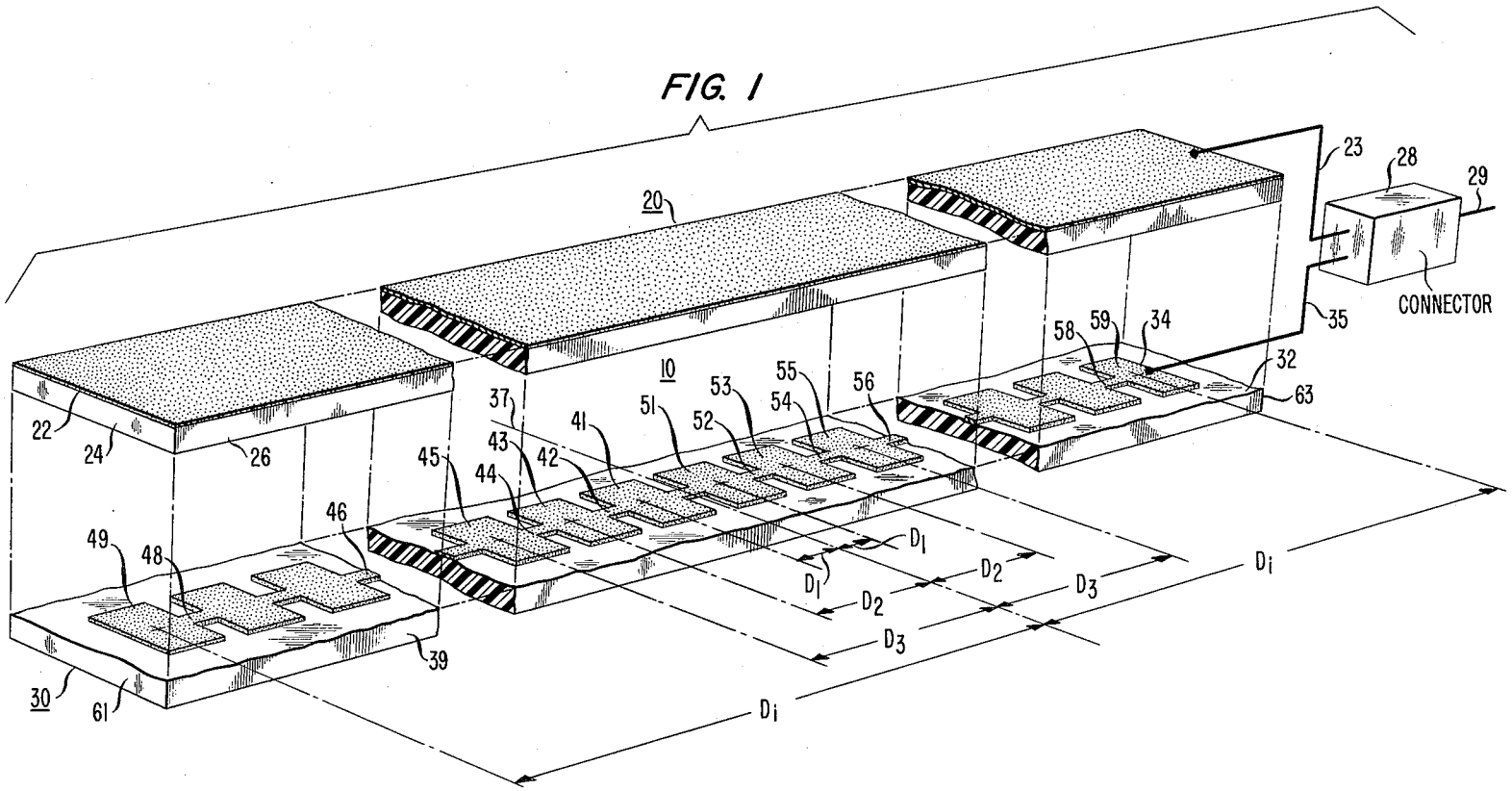

Referring to the FIGURE, there is shown an isometric view a disassembled acoustic transducer 10 embodying the present invention. Electret roil 20 comprises a metal layer 22 directly in contact with a polymer layer 24. The bottom surface 26 of polymer layer 24 is flat and has induced therein a uniform electrostatic charge. The metal layer 22 is connected via lead 23 through connector 28 to a utilization means (not shown).

The backplate 30 has a rough surface 32 so that when electret foil 20 is placed directly on surface 32, the air pockets between the flat polymer surface 26 and the rough backplate permit vibration of the electret foil 20.

Backplate 30 has deposited on rough surface 32 a metallic electrode 34. Metallic electrode 34 is connected via lead 35 to connector 28.

Referring more particularly to the metallic electrode 34, there are shown a plurality of discrete areas, or blobs, or islands 41,43,45 . . . 49 at distances $D_1,D_2,D_3 . . . D_i$, respectively, from a center 37 of the metal electrode 34. The islands 41,43,45 . . . 49 are interconnected by thin strips, or isthmuses 42,44,46 . . . 48, respectively.

Likewise, islands 51,53,55 . . . 59 are located at distances $D_1,D_2,D_3 . . . D_i$, respectively, on the opposite side of center 37 of the metallic electrode 34. Islands 51,53,55 . . . 59 are interconnected by isthmuses 52,54,56 . . . 58, respectively.

Furthermore, islands 41,43,45 . . . 49 and 51,53,55 . . . 59 are located symmetrically on opposite sides of center 37 of the metallic electrode 34. The distances $D_1,D_2,D_3 . . . D_i$ bear a nonlinear relationship to each other as disclosed in U.S. patent application, Ser. No. 104,375, filed Dec. 17, 1979 by Mr. Robert L. Wallace, Jr., and assigned to the same assignee herein, and now U.S. Pat. No. 4,311,874.

In the aforesaid Wallace patent incorporated herein by reference, a plurality of acoustic transducers are arranged in an array according to a predetermined relationship. In the present invention, however, a single transducer is used having a single backplate. The metal islands on the backplate correspond to the transducers in the Wallace array. Thus, when acoustic waves impinge on the metal layer 22 of the electret foil 20, the electret foil 20 vibrates causing the air pockets between the electret foil 20 and the rough surface 32 of backplate 30 to correspondingly contract and expand. In response to the air contraction and expansion, the islands 41,43,45 . . . 49 and 51,53,55 . . . 59 convert the acoustic energy to electrical signals, sum the signals and transmit the signals over lead 35 to the connector 28. That is, the summing of the signals take place within the acoustic transducer 10.

Because the metal electrode 34 is continuous, a template (not shown) may be placed on surface 32 of the backplate 30 and the metal evaporated thereon. Alternatively, the entire surface 32 of backplate 30 may be coated with the metal layer 32 and the pattern of metallic electrode 34 obtained by lazer trimming.

The shape of the islands 41,43,45 . . . 49 and 51,53,55 . . . 59 are irrelevant. The areas of the aforesaid islands, however, are important in determining the sensitivity. In order to insure uniform sensitivity, all the islands have substantially the same area. Alternately, if the aforesaid islands have different areas, the corresponding distances of the aforesaid distances $D_1, D_2, D_3 . . . D_i$ of the islands from the center metal electrode 34 must be varied.

In another embodiment of the present invention (not shown), the metallic electrode 34 and the metallayer 22 may be interchanged.

The response pattern in both of the aforesaid embodiments comprise a main lobe and a plurality of sidelobes at or below a predetermined threshold level. The response pattern is disclosed in greater detail in the aforesaid Wallace application and the specification of that application is incorporated by reference herein.

When the backplate 30, metallic coating 34, and electret foil 20 are fabricated from pliable material, the entire acoustic transducer 10 may be rolled into a compact package for shipping.

In the assembled state, electret foil 20 is placed directly in contact with backplate 30 so that the flat polymer surface 26 and the metallic electrode 34 are in direct contact.

The acoustic transducer 10 may be used as a microphone or a loudspeaker. When used as a microphone for teleconferencing, backplate surface 39 of acoustic transducer 10 may be placed on a supporting member (not shown) and the end 61 of the transducer 10 mounted on a pedestal (not shown). Alternatively, ends 61 and 63 may be suspended from a ceiling, or the assembly placed on a wall.

What is claimed is:

1. An acoustic transducer for producing a directional response pattern comprising:

a backplate;

an electret foil superimposed directly on said backplate, the surface of said backplate being coated with a metal electrode, said metal electrode comprising a plurality of discrete areas interconnected by a plurality of thin strips, said discrete areas being located symmetrically on opposite sides of the center of said metal electrode, the distance between any of said discrete areas and said metal electrode center being given by the application of the recursive formulae:

$$D_i' = D_i - \Delta D_i$$

$$\Delta D_i = -2KR/(2\pi \text{Sin } J) \text{ Sin } (2\pi D_i \text{ Sin } J),$$

where,

R = response of said array,

K = ΔR/R, desired fractional change in response,

ΔR = desired change in response,

J = angle between arriving incident sound and the normal to said array, $D_i$ = initial distance of the $i^{th}$ element from the center of said array, and $D_i'$ = final distance of the $i^{th}$ element from the center of said array.

2. The acoustic transducer according to claim 1 wherein said discrete areas have substantially the same area.

3. The acoustic transducer according to claim 1 wherein said surface of said backplate is rough thereby providing air pockets between said rough surface and said electret foil for vibration of said electret foil.

4. The acoustic transducer according to claim 1 wherein said electret foil comprises a metal layer and a polymer layer.

5. The acoustic transducer according to claim 4 wherein said polymer layer has induced therein a uniform electrostatic charge.

6. The acoustic transducer according to claim 4 wherein said metal layer and said metallic electrode are connected to a utilization means through a connector.

7. A continuous strip directional transducer for use in teleconferencing arrangements comprising:

an electret foil having a metal layer and a polymer layer with a uniform electrostatic charge therein, and a backplate having a rough surface and a metallic electrode deposited on said rough surface; said metallic electrode comprising a plurality of substantially identical large areas interconnected by a plurality of thin strips, said large areas being located symmetrically on opposite sides of the center of said metallic electrode at distances from said metallic electrode center in accordance with the recursive formulae:

$$D_i' = D_i - \Delta D_i$$

$$\Delta D_i = -2KR/(2\pi \text{Sin } J) \text{ Sin } (2\pi D_i \text{ Sin } J),$$

where,

R = response of said array,

K = ΔR/R, desired fractional change in response,

ΔR = desired change in response,

J = angle between arriving incident sound and the normal to said array, $D_i$ = initial distance of the $i^{th}$ element from the center of said array, and $D_i'$ = final distance of the $i^{th}$ element from the center of said array.

* * * * *